US005171162A

United States Patent [19]

Kaufman

[11] Patent Number: 5,171,162

[45] Date of Patent: Dec. 15, 1992

[54] RF COAXIAL CABLE TAP INTERCONNECT

[76] Inventor: Theodore P. Kaufman, 3141 Talisman, Dallas, Tex. 75229

[21] Appl. No.: 634,538

[22] Filed: Dec. 27, 1990

[51] Int. Cl.[5] ..... H01R 4/26

[52] U.S. Cl. ..... 439/394; 439/425; 439/579

[58] Field of Search ..... 439/393, 394, 425, 579, 439/580

[56] References Cited

U.S. PATENT DOCUMENTS

| | | | |
|---|---|---|---|
| 2,843,827 | 7/1958 | Blander | 439/394 |
| 4,588,249 | 5/1986 | Blichasz et al. | 439/394 |
| 4,746,307 | 5/1988 | Joly et al. | 439/394 |
| 4,850,895 | 7/1989 | Arai et al. | 439/394 |
| 4,972,505 | 11/1990 | Isberg | 439/394 |

*Primary Examiner*—Paula A. Bradley
*Attorney, Agent, or Firm*—Warren H. Kintzinger

[57] ABSTRACT

A coaxial cable tap is provided for connection to a coaxial line that is accomplished without disconnection of the coaxial line or otherwise disrupting service. A precise oval area of the outer jacket and shield is removed along with a controlled depth penetration of the dielectric material surrounding the center conductor in the area of the cable where the coaxial cable tap is to be positioned. The tap coupling block has a groove fitting the cable outer surface and a retaining cover, attached by screws, that, as tightened down forcing the cable down into the groove, a coaxial center probe is forced through the dielectric and into the center conductor. At the same time conductive contact members are brought into contact with the coaxial conductive shield thereby establishing an electrical path between the coaxial shield and the metallic body of the tap coupling block. The cross-sectional geometry of the coupling block with its dielectric insulator and its center conductor is approximately the same as that of the coaxial cable tapped with the tap, feeding a coaxial line, having characteristics equal to or superior to those achievable with presently available commercial "T" adapters.

8 Claims, 5 Drawing Sheets

RF COAXIAL CABLE TAP INTERCONNECT

Figure 1:
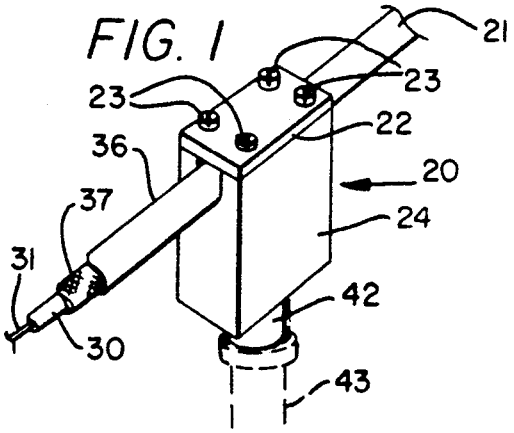

This invention relates in general to coaxial cable taps, and more particularly, to RF coaxial taps permitting a tap connection to be made to an RF coaxial line without disconnection of the coaxial line and without disrupting service.

Conventional coaxial cable taps available on the market have required disconnection of the cable and the insertion of a "T" which with installation obviously entails a disruption of service. Various intelligence services are rumored to have and to have used temporary probes for the monitoring of analog telecommunication lines, but reliable permanent taps for high speed digital signal transmission lines particularly RF coaxial transmission lines have not been available. When a tap is being installed in order to avoid disruption of service neither the center conductor of a coaxial line nor the surrounding shield can be severed, nor can the line shield be permitted to come into electrical contact with the line center conductor. Further, it is important that the geometry of the coaxial transmission line not be materially altered, and the connection to the coaxial line center conductor must not impose a significant load on the line.

It is therefore a principal object of this invention to provide an R.F. coaxial cable tap interconnection that may be made without disrupting service on the line.

Another object is to provide such an RF coaxial cable tap interconnection that may be completed without disconnection of the coaxial cable line.

A further object is to provide RF coaxial cable tap structures and the process of installation providing highly reliable permanent taps for high speed digital signal transmission coaxial lines.

Still another object is to provide a tap structure for RF coaxial cable line systems having transmission characteristics equal to or superior to those achieved with many presently available commercial transmission line "T" adapters.

Features of the invention useful in accomplishing the above objects include, in RF coaxial cable line taps, a coaxial cable tap for connection to a RF coaxial cable line without disconnection of the coaxial line or otherwise disrupting service. A precise oval area of the outer jacket and shield is removed along with a controlled depth penetration of the dielectric material surrounding the center conductor in the area of the cable where the coaxial cable tap is to be positioned. The tap coupling block has a groove fitting the cable outer surface and retaining cover, attached by screws, that, as tightened down forcing the cable down into the groove, a coaxial center probe is forced through the dielectric and into the center conductor. At the same time conductive contact members are brought into contact with the coaxial conductive shield thereby establishing an electrical path between the coaxial shield and the metallic body of the tap coupling block. The cross-sectional geometry of the coupling block with its dielectric insulator and its center conductor is approximately the same as that of the coaxial cable tapped with the tap, feeding a coaxial line, having characteristics equal to or superior to those achievable with presently available commercial "T" adapters. In a first embodiment the conductive contact members are pointed probes shorter than the coaxial center probe and longitudinally displaced along the coaxial cable line being tapped in opposite directions beyond the opposite ends of the oval area of outer jacket and shield removal with the pointed probes penetrating the outer jacket and in electrical conductive contact with the coaxial cable shield. In another embodiment conductive braid areas mounted in the tap coupling block as the conductive contact members are brought into contact and maintained in contact with exposed shield area at opposite ends of the oval cut out area.

Specific embodiments representing what are presently regarded as the best modes of carrying out the invention are illustrated in the accompanying drawings.

Figure 2:
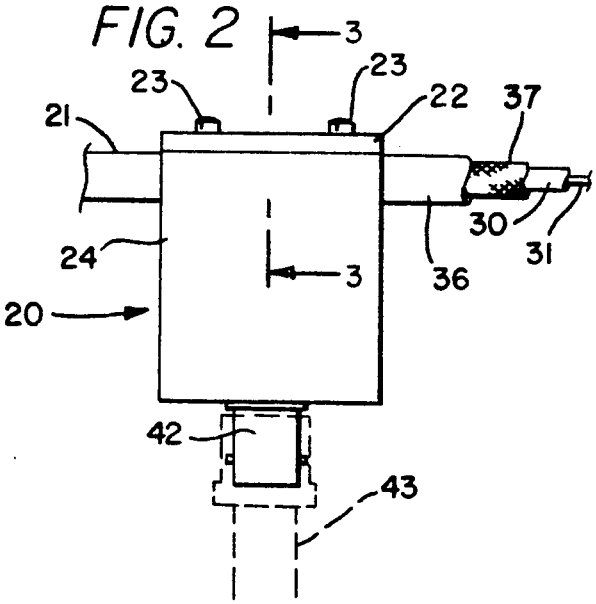
Figure 3:
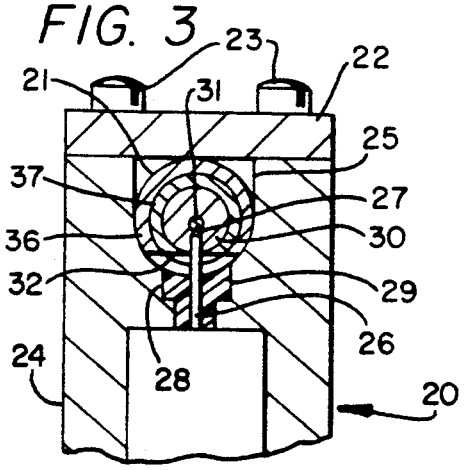
Figure 5:
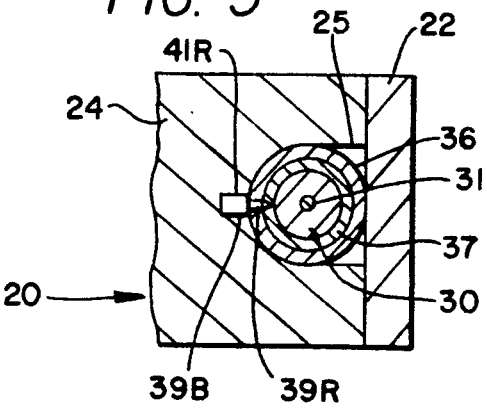
Figure 4:
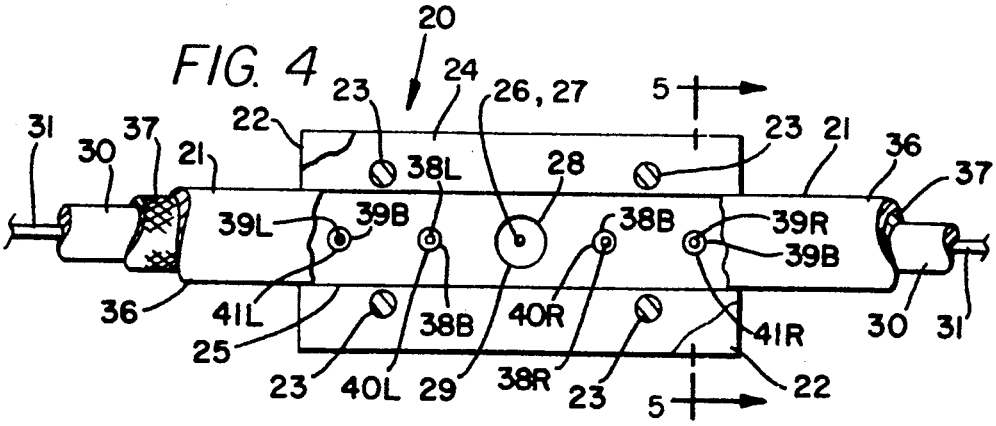
Figure 6:
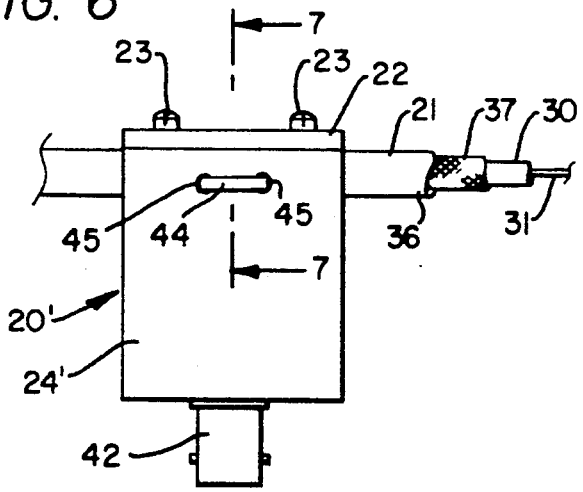
Figure 7:
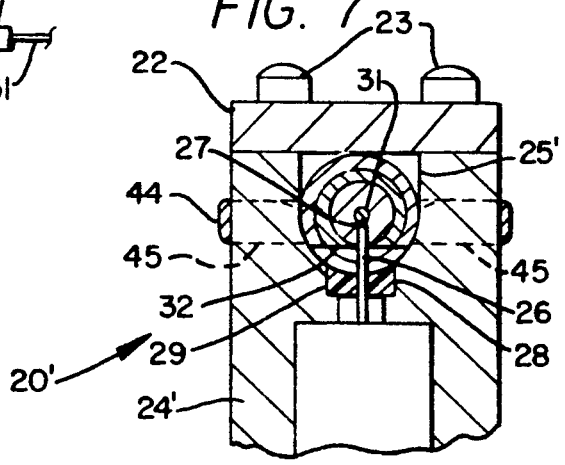
Figure 8:
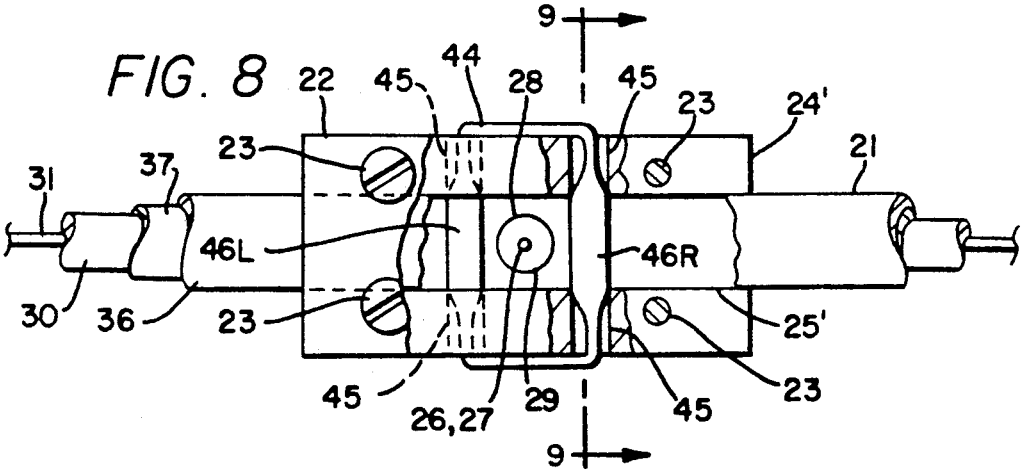
Figure 9:
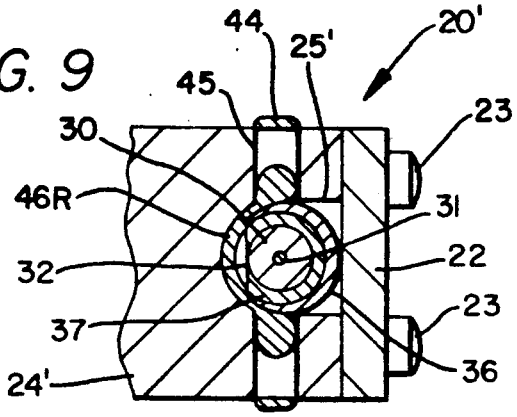
Figure 10:
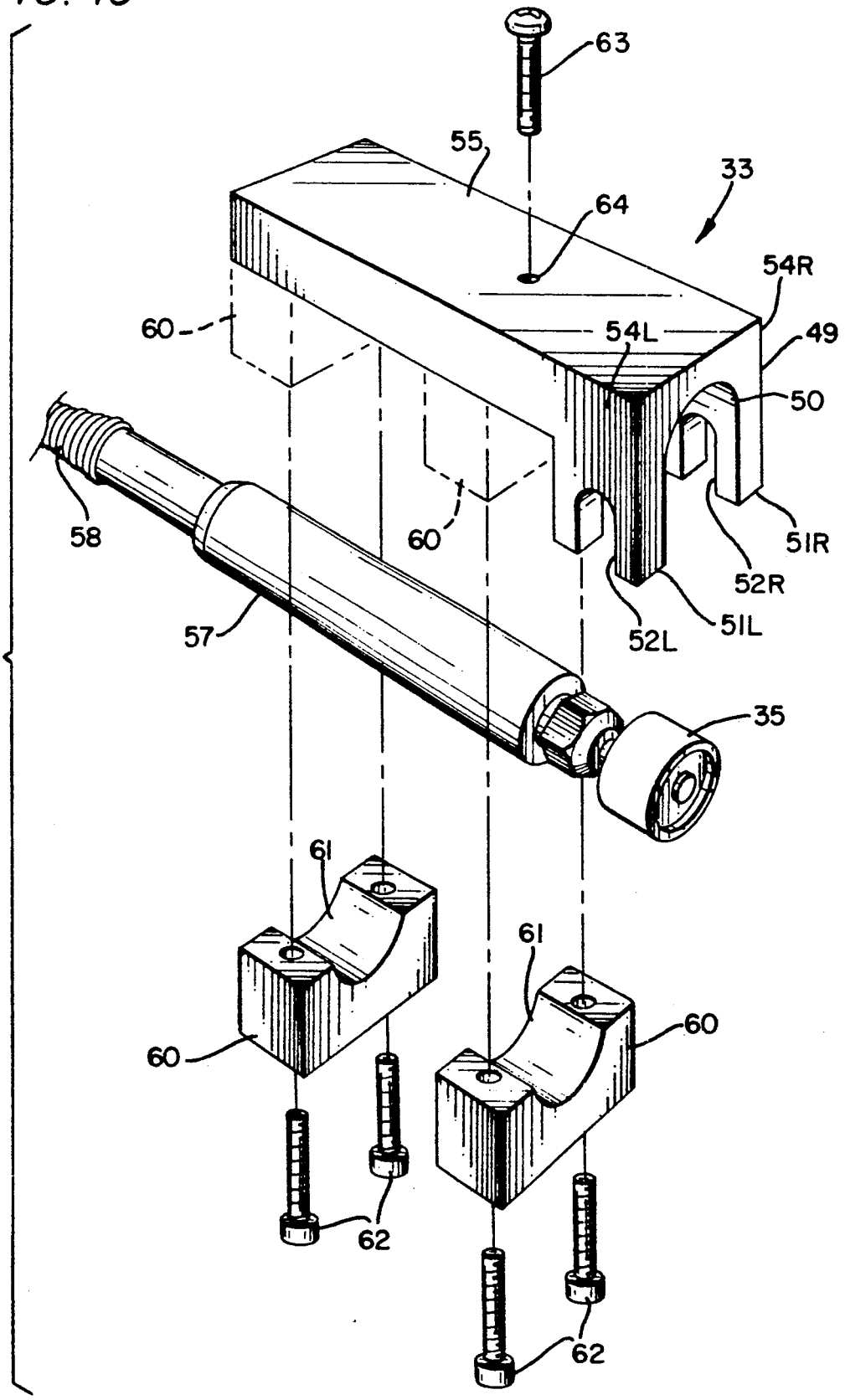
Figure 11:
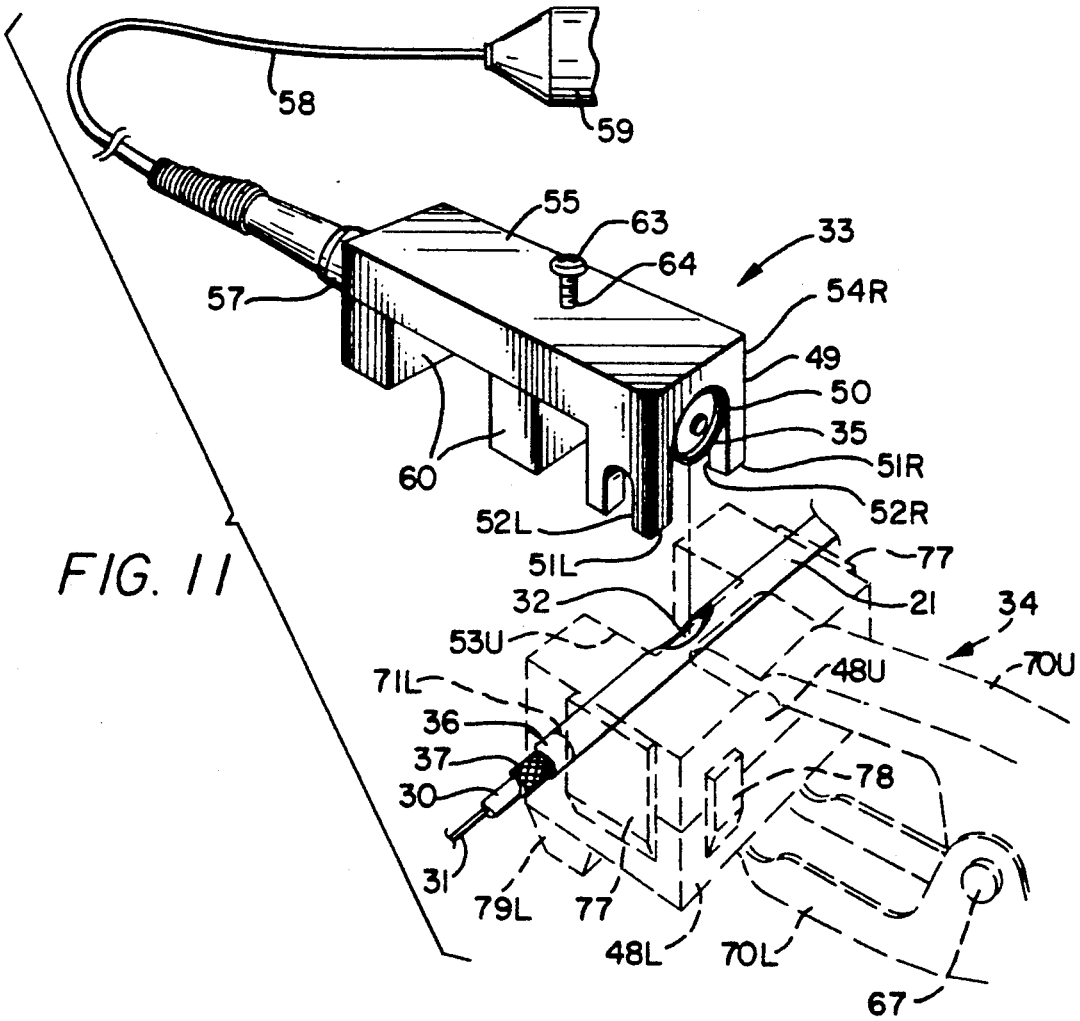
Figure 12:
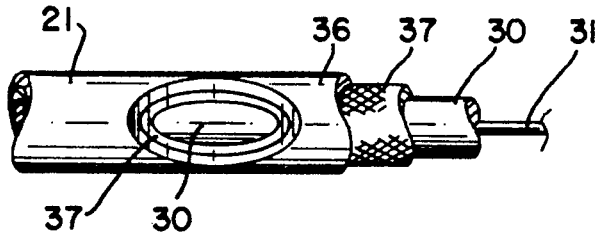
Figure 13:
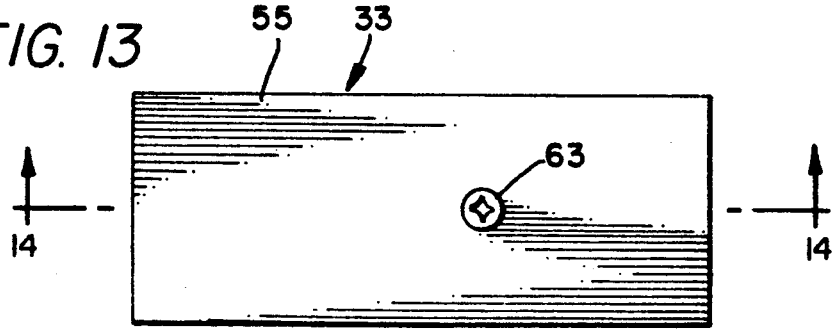
Figure 14:
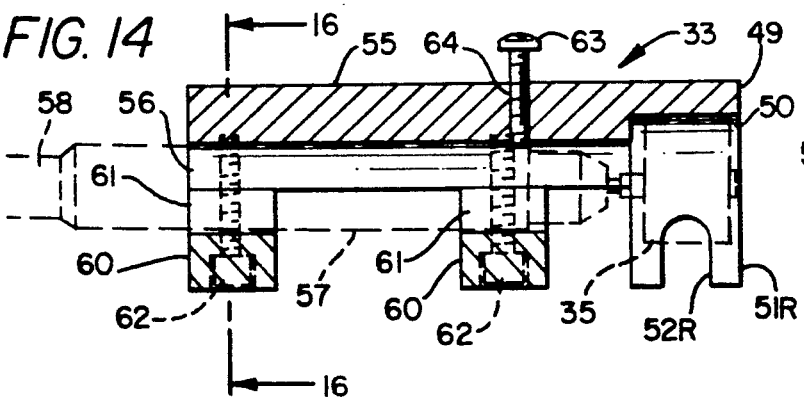

In the drawings:

FIG. 1 represents a perspective view of a coaxial line tap installed on an RF coaxial line for feeding transmitted signal to a tap coaxial line;

FIG. 2, a side elevation view of the coaxial line tap of FIG. 1;

FIG. 3, a partial cut away and sectioned view taken along line 3—3 of FIG. 2 showing coaxial cable line detail with the cable cut out and a coaxial probe extended through the coaxial cable dielectric into the center conductor;

FIG. 4, a partially cut away view with much of the tap block cover plate removed and a portion of the RF coaxial line removed to show tap block groove, tap coaxial center probe, and pointed probes to shield contact member detail;

FIG. 5, a partial cut away view taken along line 5—5 of FIG. 4 showing pointed probe to coaxial line shield contact detail;

FIG. 6, a side elevation view of another coaxial line tap embodiment employing conductive metal braid, mounted in the tap block, that contacts exposed area of the coaxial cable shield at opposite ends of a tap cut out;

FIG. 7, a partial cut away and sectioned view taken along line 7—7 of FIG. 6 showing coaxial cable line detail with the cable cut out and the coaxial center probe extended through dielectric into the center conductor;

FIG. 8, a partially cut away view with much of the tap block cover plate removed and a portion of the RF coaxial line removed to show the tap block groove, tap coaxial center probe, and coaxial cable shield contact braid;

FIG. 9, a partial cut away view taken along line 9—9 of FIG. 8 showing conductive metal braid to coaxial cable shield contact detail;

FIG. 10, an exploded perspective view of a grinding tool assembly used for grinding a precise oval area of material removed in the outer jacket and shield of a coaxial cable along with a controlled depth penetration into dielectric material surrounding the center conductor of the cable;

FIG. 11, a perspective view of the grinding tool as lifted away from a coaxial cable after having ground an oval area in the cable as held by the jaws of a resiliently closed pincher tool;

FIG. 12, an enlarged showing of coaxial cable with a ground out oval area for a "T" connection;

FIG. 13, a top plan view of the grinding tool block;

FIG. 14, a cut away and sectioned side elevation view of the grinding tool block assembly taken from line 14—14 of FIG. 13.

Figure 15:
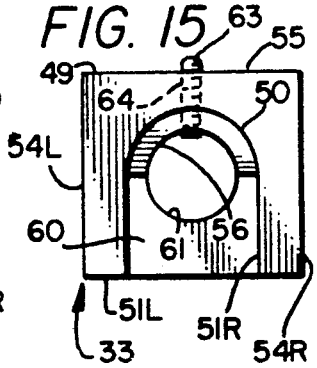
Figure 16:
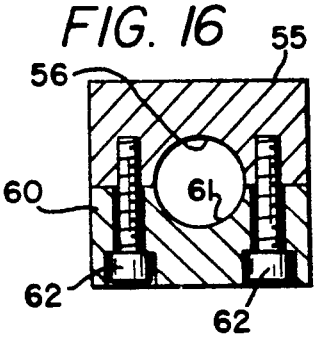
Figure 19:
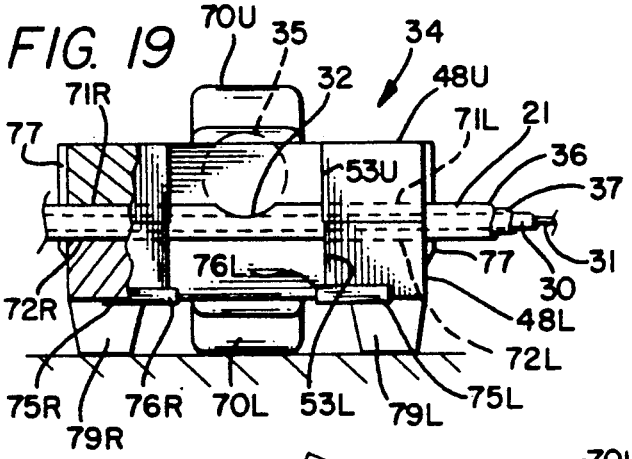
Figure 17:
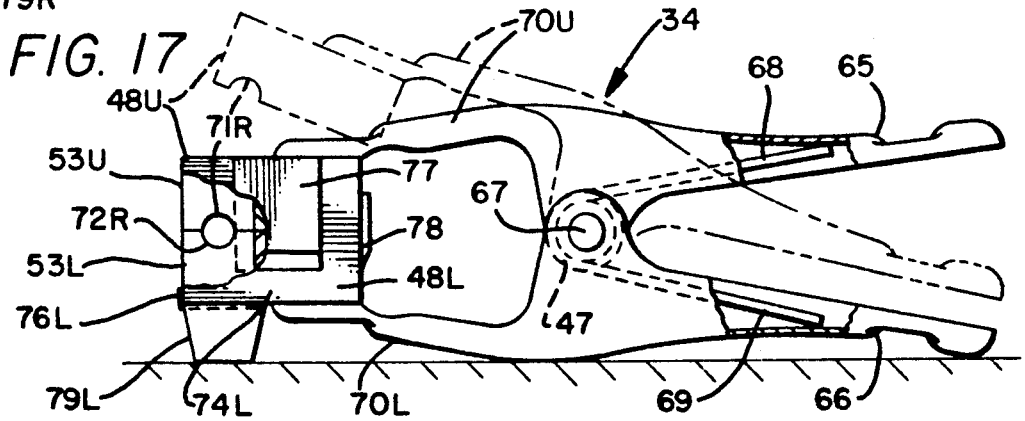
Figure 18:
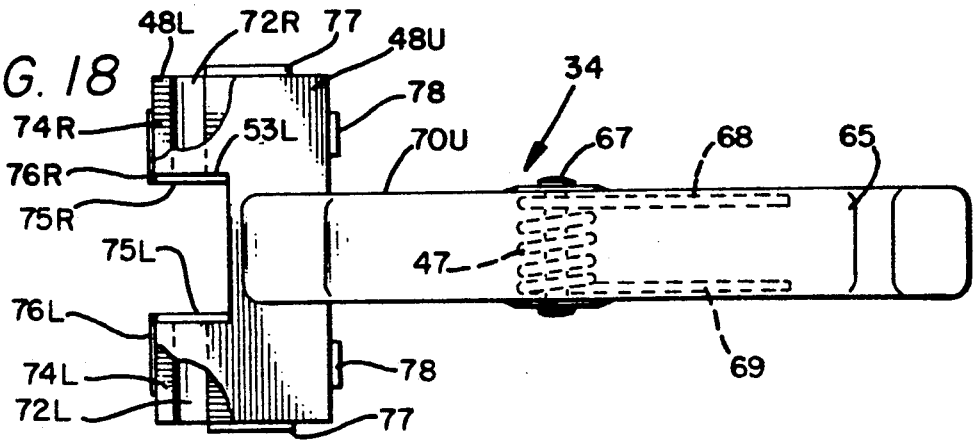

FIG. 15, a front end view of the grinding tool block assembly;

FIG. 16, a cut away and sectioned view of grinding tool block assembly detail taken from line 16—16 of FIG. 14;

FIG. 17, a partially broken away and sectioned side elevation view of a resiliently biased to closure coaxial cable holding clamp having a clamp head guiding channel for the grinding tool block assembly;

FIG. 18, a partially broken away and sectioned top elevation view of the resiliently biased to closure coaxial cable holding clamp of FIG. 17; and, FIG. 19, a partially broken away and sectioned front clamp end of the resiliently biased to closure coaxial cable holding clamp of FIGS. 17 and 18.

Referring to the drawings:

A coaxial cable tap 20 is shown attached to an RF coaxial cable 21 in FIGS. 1-5 with a retaining cover plate 22 tightened down by four screws 23 onto the cable 21 enclosing end of tap coupling block 24, that is rectangular, has a transversely side to side extended groove 25 with the bottom curved to fit the cable 21 and sufficient depth to receive the cable 21 within plate 22. A center probe 26 with a pointed end 27 is mounted by a dielectric insulator 28 in opening 29 of block 24 to extend outwardly into groove 25 sufficiently far to be forced through the dielectric sheath 30 and into center conductor 31. This probe 26 insertion into the coaxial cable line 21 is in the middle of a ground out oval area 32 such as also shown in FIGS. 11 and 12 in coaxial cable 21 for a "T" connection thereto. The ground out oval area 32 is produced with a grinding tool assembly 33 shown in part or entirely in FIGS. 10, 11 and 13-16 as guided by a spring biased to close jaws of a cable holding and grinding tool guide pincher tool 34 shown in part or entirely in FIGS. 11 and 17-19. The ground out oval area 32 that is very precise is ground down with a 0.62 inch diameter non-conductive grinding wheel 35 removing a precise oval area of the coaxial cable outer insulative material jacket 36 and conductive metal shield 37 and into the dielectric material 30 surrounding the center conductor 31 by a controlled amount, but with the grinding wheel 35 being non-conductive, the characteristics of the transmission line are not discernably affected. Pointed probes 38L, 38R, 39L and 39R have enlarged cylindrical bases 38B and 39B that are swaged in place in openings 40L, 40R, 41L and 41R, respectively, to the left and right from center probe 26, longitudinally centered in the groove 25 of tap coupling block 24. The pointed probes 38L, 38R, 39L and 39R with pointed ends are forced through the coaxial cable outer insulative material jacket 36 and into electrical contact with the conductive metal shield 37 as the cover plate 22 is tightened down by the four screws 23 onto tap coupling block 24 which is a conductive metal block thereby establishing a through conductive path to the conductive metal shield of the "T" connection via output port 42 to the coaxial cable tap line 43. The pointed probes 38L, 38R, 39L and 39R also position stabilize the insulative material jacket 36 and the conductive metal shield 37 from rotational twist or longitudinal displacement relative to each other.

Referring now to the coaxial cable line tap 20' embodiment of FIGS. 6-9 a metal braid contact strip loop 44 is mounted to extend through opposite side openings 45 in the tap coupling block 24' as the electrical contact with the conductive metal shield 37 of the cable 21 being tapped. The tap 20' has many similarities with the tap 20 of FIGS. 1-5 with portions thereof the same so as a matter of convenience many components are numbered the same, some are given prime numbers and those that are different are given new numbers. Four free shank screws 23 are used to tighten retaining cover plate 22 down onto the cable 21 enclosing end of conductive metal tap coupling block 24', that again is rectangular, having a transversely side to side extended groove 25'. Here again a center probe 26 with a pointed end 27 is mounted by a dielectric insulator 28 in opening 29 of block 24' to extend outwardly into groove 25' sufficiently far to be forced through the dielectric sheath 30 and into center conductor 31. This occurs as the screws 23 tighten plate 22 down on tap coupling block 24' with insertion thereof in the middle of the ground out oval area 32. In any event with this embodiment the two portions 46L and 46R of conductive metal braid loop 44 are mashed down on opposite exposed ends of the conductive metal shield 37 in the oval ground out area 32. It is important that these tap connections be made to a coaxial cable line without disconnection of a cable and without disruption of service. This entails that neither the center conductor nor the surrounding conductive material shield be severed, and the shield cannot be permitted to be brought into electrical contact with the center conductor. Transmission line geometry must not be significantly altered, and the tap connection to the coaxial cable line center conductor must not represent a significant load on the line.

The spring 47 biased to close jaws 48U and 48L of the cable holding and grinding tool assembly 33 guide pincher tool 34 of FIGS. 11 and 17-19 is firmly attached in place to the coaxial cable line 21 at the point where the line tap is to be installed. The grinding tool assembly 33 has a guide head 49 with a "U" shaped opening 50 within which grinding wheel 35 is positioned and opposite side legs 51L and 51R with bottom duplicate "U" shaped openings 52L and 52R that fit the coaxial cable line 21 being tapped. The grinding tool assembly 33 guide head 49 is slid into guide channels 53U and 53L of the tool 34 and pressed firmly onto the cable with the 0.62 inch diameter non-conductive grinding wheel removing a precise oval area of the outer jacket and shield of the cable line 21. At the same time the dielectric material surrounding the center conductor is penetrated a controlled amount but not so much as to expose the center conductor. The grinding tool assembly 33 is removed and with the guide channel 53U and 53L equipped pincher tool 34 left in place on the cable 21 with guide channels 53U and 53L now used as a guide for the tap coupling block 24 (24'). This insures that the center conductor probe 26 is in the exact center of the exposed dielectric area ground into the cable 21 as it is pushed through the dielectric 30 and into contact with the center conductor 31 as the retaining cover plate 22 is tightened down by the four screws 23. Simultaneously, with the embodiment of FIGS. 1-5, the shorter pointed probes 38L, 38R, 39L and 39R are pushed through the cable outer insulative material jacket 36 into contact with conductive material shield 37. With the embodiment of FIGS. 6-9 simultaneously with movement of the center probe 26, through dielectric 30 and into contact with center conductor 31, the metal braid portions 46L and 46R are mashed down on opposite exposed ends of the conductive metal shield 37 in the oval ground out area 32. This all occurs while the tool guide pincher tool 34, that is also a guide for the tap block 24, is still firmly attached to the coaxial cable The metal braid portions 46L and 46R are compressed in making electrical contact between the coaxial shield 37 and the metallic body of the tap coupling block 24'. Again the cross-sectional geometry of the tap coupling block 24' with its dielectric insulator 28' and its center conductor is approximately the same as that of coaxial cable line 21 with a tap thereby accomplished with characteristics equal to or superior to those achievable with commercial "T" adapters available on the market heretofore.

The grinding tool assembly 33 head 49 with opposite sides 54L and 54R in free sliding guided fit between the opposite side walls of guide channels 53U and 53L, and the side walls of channel 53L are spaced a little wider to prevent binding lock of tool head 49 therein. The tool assembly 33 has a body block 55 that extends rearwardly from head 49 and has a semi-circle longitudinally extended groove 56 on the underside thereof into which the power drive output portion 57, of a flex shaft 58 from a driving electric motor tool 59 mounting grinding wheel 35, is fitted. Two mounting blocks 60 with matching grooves 61 are mounted by allen head screws 62 in holding power drive output portion 51 in the groove 56 along with position locking screw 63 tightened down from above tool body block in threaded hole 64 therethrough.

The spring 47 biased to close cable holding and grinding tool assembly 33 guide pincher tool 34 of FIGS. 11 and 17–19 has hand grippable handles 65 and 66 pivotal about pivot pin 67 that also mounts coil spring 47 with opposite end extension arms 68 and 69 retained, respectively, within handles 65 and 66 resiliently biasing them apart and thereby clamping jaws 48U and 48L together. Clamping jaws 48U and 48L are welded, respectively, to forward extensions 70U and 70L from handles 65 and 66 and from pivot pin 67. Each of the clamping jaws 48U and 48L are biforcated jaws, enclosing guide channels 53U and 53L, respectively, and there are semi-circle grooves 71L and 71R that align with semi-circle grooves 72L and 72R in the forwardly extended jaw projections 73L and 73R of upper clamping jaw 48U and projections 74L and 74R of lower clamping jaw 48L, respectively. The grooves 72L, 72R, 73L and 73R enclose and clamp on coaxial cable line 21 to establish a tap location thereon guiding first the grinding tool assembly 33 head 49 in its cable grinding operation for a tap and then remaining in place to guide the tap body 24 (24') and the cover plate 22 as they are tightened together with screws 23 fixing the tap in place on coaxial cable line 21. Flange members 75L and 75R mounted to the bottoms, respectively, of the projections 74L and 74R of lower jaw 48L to extend a short distance from each side into the space between the lower projections 74L and 74R as a support for a retaining cover plate 22 in place for being tightened on to a tap coupling block 24 by screws 23. Forward upturned front retaining flanges 76L and 76R of the flange members 75L and 75R serve to help retain a cover plate 22 placed in guide channel 53 of tool 34 on flange members 75L and 75R. Opposite side guide plates 77 and rear guide plates 78 are welded to the opposite sides and rear of clamping jaw 48L as alignment guides for clamping jaw 48U in opening and closing of the jaws. Resilient support pads 79L and 79R are mounted on the bottom of clamping jaw 48L projections 74L and 74R as a support for the tool 34 on work table surfaces.

The oval cut out area 32 in a coaxial cable line 21 is totally covered within the machined groove 25 of a tap coupling block 24 and resilient compression of the outer insulative material jacket 36 serves to reliably seal the tap connection area once the retainer plate 22 is tightened in place on the tap coupling block 24 (24') by screws 23 to thereby provide a rugged shielded permanent coaxial cable line tap. Such a tap may be used for interconnection with a variety of circuitry including filters, amplifiers, attenuators, impedance transformation circuitry, power splitters and any number of other circuit devices and configurations.

Whereas this invention has been described with respect to several embodiments thereof, it should be realized that various changes may be made without departure from the essential contributions to the art made by the teachings hereof.

I claim:

1. In combination, a coaxial cable and an RF coaxial cable tap interconnect therefore, said cable tap interconnect having an outer insulative material jacket, a cylindrical conductive metal shield, a dielectric material cylindrical layer and a center conductor within the dielectric material cylindrical layer and having a ground out portion through the insulative material jacket and the cylindrical conductive metal shield down into the dielectric material cylindrical layer, comprising: a ground out oval shaped area extending through the insulated material jacket and the cylindrical conductive metal shield down into the dielectric material cylindrical layer of said coaxial cable; a tap coupling block with a metallic electrically conductive body having a groove fitting the cable insulative material jacket; a retaining cover attachable by screws to said coupling block overlying said groove and said coaxial cable positionable in the groove; a coaxial center probe mounted in the groove of said tap coupling block forced through the dielectric material cylindrical layer and into the center conductor establishing a tap connector as said retaining cover is tightened down by said screws to said coupling block body; and conductive contact means brought into contact with said cylindrical conductive metal shield as said retaining cover is tightened down by said screws to said coupling block; wherein with the outer insulative material jacket being resiliently compressible and said ground out oval shaped area contained within a portion of said groove fitting the cable outer insulative material jacket around said ground out oval shaped area and said tap connection that is reliably seal enclosed as said retaining cover is tightened down by said screws to said tap coupling block; and wherein said tap coupling block is a rectangular block having said groove fitting the cable insulative material jacket at a first end; and a tap coaxial cable connection at a second end of said rectangular block; and proper centered alignment of said coaxial center probe with said ground out oval area to pass through said dielectric material cylindrical layer and into electrical conductive contact with the center conductor without the center probe making contact with said cylindrical conductive metal shield as said retaining cover is tightened down by said screws to said coupling block body.

2. The RF coaxial cable tap interconnect for a coaxial cable line of claim 1, wherein said conductive contact means is pin means that penetrates said outer insulative material jacket and contacts said cylindrical conductive shield of a coaxial cable outside the area of said ground out oval shaped area in the cable as said retaining cover is tightened down by said screws to said tap coupling block.

3. The RF coaxial cable tap interconnect for a coaxial cable line of claim 2, wherein said pin means is multiple pins of conductive metal mounted in conductive metal in the tap coupling block groove with said multiple pins longitudinally spaced along said groove to engage a coaxial cable beyond opposite ends of said ground out oval shaped area in a coaxial cable having the tap interconnection.

4. The RF coaxial cable tap interconnect for a coaxial cable line of claim 3, wherein said coaxial center probe is mounted in an insulative material plug held in an opening to the interior of said tap coupling block that is connected to be in signal communication with a tap coaxial line.

5. The RF coaxial cable tap interconnect for a coaxial cable line of claim 3, wherein said multiple pins are four pins two each longitudinally spaced beyond each end of said ground out oval tap connection area of a coaxial cable connected to said tap interconnection.

6. The RF coaxial cable tap interconnect for a coaxial cable line of claim 1, wherein said retaining cover attachable by screws to said coupling block is a rectangular cover with a screw at each corner of the cover for attaching said rectangular retaining cover to said coupling block.

7. An RF coaxial cable tap interconnect for a coaxial cable line having an outer insulative material jacket, a cylindrical conductive metal shield, a dielectric material cylindrical layer and a center conductor within the dielectric material cylindrical layer and having a ground out oval area through the insulative material jacket and the cylindrical conductive metal shield down into the dielectric material cylindrical layer, comprising: a tap coupling block with a metallic electrically conductive body having a groove fitting the cable insulative material jacket; a retaining cover attachable by screws to said coupling block overlying said groove and a coaxial cable positionable in the groove; a coaxial center probe mounted in the groove of said tap coupling block forced through the dielectric material cylindrical layer and into the center conductor establishing a tap connection as said retaining cover is tightened down by said screws to said coupling block body; and conductive contact means brought into contact with exposed area, in said ground out oval area, of said cylindrical conductive metal shield as said retaining cover is tightened down by said screws to said coupling block; with the outer insulative material jacket being resiliently compressible and the ground out oval area contained within a portion of said groove fitting the cable outer insulative material jacket around said ground out oval area and said tap connection that is reliably seal enclosed as said retaining cover is tightened down by said screws to said tap coupling block; said conductive contact means is electrical conductive metal braid means mounted in said tap coupling block positioned to establish electrical contact between said cylindrical conductive shield and said tap coupling block as said retaining cover is tightened down by said screws to said tap coupling block; and wherein said electrical conductive contact metal braid means includes two strip sections of braid mounted in said tap coupling block in alignment, transversely across said groove, to contact exposed opposite ends, in said ground out oval tap connection area, of said cylindrical conductive shield.

8. The RF coaxial cable tap interconnect for a coaxial cable of claim 7, wherein said electrical conductive contact metal braid means is in the form of a metal braid contact strip loop mounted to extend through opposite side openings in said tap coupling block and across said groove as the electrical conductive connective means between opposite exposed ends of said cylindrical shield in said ground out oval tap connection area and said tap coupling block.

* * * * *